US011992041B2

(12) United States Patent
Uthurry

(10) Patent No.: US 11,992,041 B2
(45) Date of Patent: May 28, 2024

(54) AEROSOL-GENERATING ARTICLE HAVING FIBROUS FILTER SEGMENT AND HOLLOW, TUBULAR SUPPORT ELEMENT LOCATED IMMEDIATELY DOWNSTREAM THE AEROSOL-FORMING SUBSTRATE

(71) Applicant: Philip Morris Products S.A., Neuchatel (CH)

(72) Inventor: Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 117 days.

(21) Appl. No.: 16/603,397

(22) PCT Filed: Jun. 8, 2018

(86) PCT No.: PCT/EP2018/065229

§ 371 (c)(1),
(2) Date: Oct. 7, 2019

(87) PCT Pub. No.: WO2018/224679

PCT Pub. Date: Dec. 13, 2018

(65) Prior Publication Data

US 2020/0029616 A1 Jan. 30, 2020

(30) Foreign Application Priority Data

Jun. 9, 2017 (EP) ..... 17175358

(51) Int. Cl.
*A24D 3/17* (2020.01)
*A24D 3/10* (2006.01)
(Continued)

(52) U.S. Cl.
CPC ..... *A24D 3/17* (2020.01); *A24D 3/10* (2013.01); *A24D 3/14* (2013.01); *A24F 13/06* (2013.01); *D21H 5/16* (2013.01)

(58) Field of Classification Search
CPC ... A24D 3/17; A24D 3/10; A24D 3/14; A24D 3/04; A24D 3/063; A24F 13/06; A24F 40/10; A24F 40/46; D21H 5/16
See application file for complete search history.

(56) References Cited

U.S. PATENT DOCUMENTS 2,828,752 A * 4/1958 Jackson ..... D01D 5/253 131/345
3,563,769 A * 2/1971 Horn ..... C08B 37/0042 426/577

(Continued)

FOREIGN PATENT DOCUMENTS

CA 2021199 * 1/1991
CN 1200899 A 12/1998

(Continued)

OTHER PUBLICATIONS

EP 0255114 translation (Year: 1988).*

(Continued)

*Primary Examiner* — Jeffrey M Wollschlager
*Assistant Examiner* — Guy F Mongelli
(74) *Attorney, Agent, or Firm* — Oblon, McClelland, Maier & Neustadt, L.L.P.

(57) ABSTRACT

A aerosol-generating article is provided, including a plurality of components assembled within a wrapper to form a rod having a mouth end and a distal end upstream from the mouth end, the plurality of components including: an aerosol-forming substrate comprising plant material and an aerosol former, the aerosol-forming substrate having an aerosol former content of between 5% and 30% by weight on a dry weight basis; and a filter segment downstream of the aerosol-forming substrate, the filter segment including fibres of at least about 12 denier per filament.

10 Claims, 1 Drawing Sheet

(51) Int. Cl.

| | |
|---|---|
| ***A24D 3/14*** | (2006.01) |
| ***A24F 13/06*** | (2006.01) |
| ***D21H 27/00*** | (2006.01) |

(56) References Cited

U.S. PATENT DOCUMENTS

| | | | | | |
|---|---|---|---|---|---|
| 4,776,354 | A * | 10/1988 | Norman | A24D 1/00 | 131/365 |
| 5,632,287 | A * | 5/1997 | Hayworth | A24D 1/00 | 131/365 |
| 5,649,554 | A * | 7/1997 | Sprinkel | A24F 40/465 | 131/194 |
| 5,692,526 | A * | 12/1997 | Adams | A24C 5/01 | 131/365 |
| 5,979,459 | A * | 11/1999 | Schneider | A24D 3/043 | 131/338 |
| 2003/0159703 | A1* | 8/2003 | Yang | A24D 1/002 | 131/335 |
| 2004/0134631 | A1* | 7/2004 | Crooks | A24D 1/025 | 162/139 |
| 2008/0216851 | A1* | 9/2008 | Olegario | A24D 3/045 | 131/202 |
| 2009/0288669 | A1* | 11/2009 | Hutchens | A24D 3/0216 | 131/274 |
| 2012/0255569 | A1* | 10/2012 | Beard | A24D 3/04 | 131/334 |
| 2013/0112214 | A1 | 5/2013 | Bundren et al. | | |
| 2014/0026910 | A1* | 1/2014 | Bundren | D01F 2/28 | 425/381.2 |
| 2014/0026911 | A1* | 1/2014 | Bundren | A24D 3/064 | 131/332 |
| 2014/0261487 | A1 | 9/2014 | Chapman et al. | | |
| 2014/0305448 | A1 | 10/2014 | Zuber et al. | | |
| 2015/0027475 | A1* | 1/2015 | Jarriault | A24D 3/048 | 131/329 |
| 2015/0111452 | A1* | 4/2015 | Dugan | D01F 6/625 | 442/202 |
| 2015/0128964 | A1 | 5/2015 | Bundren et al. | | |
| 2015/0313281 | A1* | 11/2015 | Bonici | A24D 1/002 | 131/276 |
| 2016/0150825 | A1* | 6/2016 | Mironov | A24F 40/465 | 219/634 |
| 2018/0116277 | A1* | 5/2018 | Besso | A61K 8/347 | |

FOREIGN PATENT DOCUMENTS

| | | | | | |
|---|---|---|---|---|---|
| CN | 104159460 | A | * | 11/2014 | A24D 1/00 |
| CN | 104883913 | A | | 9/2015 | |
| CN | 104902768 | A | | 9/2015 | |
| CN | 107043978 | A | | 8/2017 | |
| EA | 016243 | B1 | | 3/2012 | |
| EA | 038543 | | * | 9/2021 | |
| FR | 2518374 | | * | 6/1983 | |
| GB | 841.878 | A | | 7/1960 | |
| JP | 62-86894 | U | | 6/1987 | |
| JP | 2012-65633 | A | | 4/2012 | |
| JP | 2015-503335 | A | | 2/2015 | |
| JP | 2015-508992 | A | | 3/2015 | |
| JP | 2015-523857 | A | | 8/2015 | |
| JP | 2016-512033 | A | | 4/2016 | |
| JP | 2016520050 | A | | 7/2016 | |
| KR | 2017/0008726 | A | * | 1/2017 | |
| WO | WO 2012/164009 | A2 | | 12/2012 | |
| WO | WO 2013/067511 | A2 | | 5/2013 | |
| WO | WO 2013/098405 | A2 | | 7/2013 | |
| WO | WO 2016/207192 | A1 | | 12/2016 | |

OTHER PUBLICATIONS

LU 87663 translation (Year: 1990).*
WO 2007/10650 (Year: 2007).*
WO-2008110931-A2 (Year: 2008).*
CN 105050435 A translation (Year: 2015).*
TW 2015/03835 translation (Year: 2015).*
International Search Report and Written Opinion dated Aug. 1, 2018 in PCT/EP2018/065229 filed Jun. 8, 2018.
Extended European Search Report dated Nov. 23, 2017, in Patent Application No. 17175358.5, 7 pages.
Combined Russian Office Action and Search Report dated Sep. 29, 2021 in Russian Patent Application No. 2019136878 (with Engiish translation), 12 pages.
Combined Chinese Office Action and Search Report dated Jul. 5, 2021 in Chinese Patent Application No. 201880032191.6 (with English translation), 19 pages.
Ukrainian Notice of Allowance dated Dec. 22, 2021 in corresponding Ukrainian Patent Application No. A201910197 (with English translation), 12 pages.
Japanese Office Action dated Jul. 6, 2022 in Japanese Patent Application No. 2019-564524 (with English translation), 12 pages.

* cited by examiner

AEROSOL-GENERATING ARTICLE HAVING FIBROUS FILTER SEGMENT AND HOLLOW, TUBULAR SUPPORT ELEMENT LOCATED IMMEDIATELY DOWNSTREAM THE AEROSOL-FORMING SUBSTRATE

The present invention relates to an aerosol-generating article comprising an aerosol-forming substrate for generating an inhalable aerosol when heated. Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

To assist with such cooling, aerosol-generating articles typically also include an aerosol-cooling element and a filter segment downstream of the aerosol-forming substrate. However, aerosol-cooling elements may be relatively complex or expensive to manufacture. Consequently, it would be desirable to provide an aerosol-generating article having properties of those in the art, but with a reduced or no need for an aerosol-cooling element.

According to the invention, there is provided an aerosol-generating article comprising a plurality of components assembled within a wrapper to form a rod having a mouth end and a distal end upstream from the mouth end. The plurality of components comprises an aerosol-forming substrate and a filter segment downstream of the aerosol-forming substrate, the filter segment comprising fibres of at least about 12 denier per filament. Preferably, the filter segment comprises at least 50% by number of fibres of at least about 12 denier per filament. More preferably, the filter segment comprises at least 70%, or at least 80%, or at least 90% by number, of fibres of at least about 12 denier per filament. Preferably, the filter segment comprises at least 50% by weight of fibres of at least about 12 denier per filament. More preferably the filter segment comprises at least 70%, or at least 80%, or at least 90% by weight, of fibres of at least about 12 denier per filament.

In contrast to known aerosol-generating articles, articles according to the present invention have a filter segment comprising fibres of at least about 12 denier per filament. This is a larger denier per filament than that of fibres used in known filter segments for aerosol-generating articles. Such denier fibres would not normally have been considered suitable for the field of aerosol-generating articles, since they would be deemed unable to provide a sufficiently high filtration efficiency. Such denier fibres would not normally have been considered suitable for combustible aerosol-generating articles, such as cigarettes, where filtration of particulate matter, such as tar, is often highly desirable.

However, the inventors of the present invention have recognised that certain advantageous effects can be obtained by utilising filter segments according to the present invention. In particular, for articles in which an aerosol-forming substrate, is heated rather than combusted, it may be desirable to have a relatively low particulate efficiency as there may be less production of constituents such as tar. In aerosol-generating articles of this type, a relatively short filter segment of conventional filtration fibres has been used to maintain a desired particulate efficiency. However, by utilising a filter segment having fibres according to the present invention the same particulate efficiency and resistance to draw can be obtained by increasing the length of the filter segment. This has the advantageous effect of reducing or eliminating the need for other complex or expensive components in the wrapped rod of the article, such as the aerosol-cooling element.

Accordingly, the inventors of the present invention have appreciated that it is possible to reduce or eliminate the need for an aerosol-cooling element by utilising a filter segment comprising fibres according to the invention. The present invention therefore may provide a way to reduce the size of the cooling element included in an aerosol-generating article, or to completely eliminate the need for one, whilst still maintaining a desirable resistance to draw and filtration efficiency in the article. The aerosol-generating article of the present invention can be manufactured using existing techniques, and may even require less manufacturing steps, if a cooling element is not being provided.

Preferably, the fibres of the filter segment have a denier per filament of about 120 or less. Preferably, the fibres of the filter segment have a denier per filament of from about 20 to about 100, more preferably of from about 30 to about 80, even more preferably of from about 40 to about 80, even more preferably of from about 40 to about 60. Preferably, said fibres of the filter segment account for at least 50% by number of the total fibres in the filter segment. More preferably, the filter segment comprises at least 70%, or at least 80%, or at least 90% by number, of fibres having said denier per filament. Preferably, said fibres of the filter segment account for at least 50% by weight of the total fibres in the filter segment. More preferably, the filter segment comprises at least 70%, or at least 80%, or at least 90% by weight, of fibres having said denier per filament.

Preferably, filter segment has a total denier of from about 6,000 to about 240,000, more preferably of from about 24,000 to about 60,000.

Preferably, the filter segment has a resistance to draw of from about 0.4 mm $H_2O$ to about 3 mm $H_2O$ per millimetre length. Preferably, the aerosol-generating article has a total resistance to draw of from about 0.6 mm $H_2O$ to about 1.5 mm $H_2O$ per millimetre length, more preferably of from about 0.8 mm $H_2O$ to about 1.2 mm $H_2O$ per millimetre length.

As noted above, it may be desirable to increase the length of the filter segment from that which may have otherwise been used in order to increase the filtration efficiency and resistance to draw of the filter segment. Accordingly, preferably, the filter segment has a length of at least 10 millimetres, more preferably at least 15 millimetres, even more preferably at least 20 millimetres. Preferably, the filter segment has a length of 25 millimetres or less. Preferably, the length of the filter segment is at least 10 percent of the length of the aerosol-generating article, more preferably at least 20 percent of the length of the aerosol-generating article, even more preferably at least 50 percent of the length of the aerosol-generating article The fibres of the present invention may be provided with a specific cross-sectional shape to calibrate the filtration efficiency and resistance to draw of the filter segment to desired values. Preferably, fibres of the filter segment have a substantially elliptical cross-sectional shape. Preferably, fibres of the filter segment have a substantially circular cross-sectional shape.

Preferably, the filter segment is located at the mouth end of the rod. Preferably the filter segment is in the form of a plug. Preferably, the fibres of the filter segment comprise cellulose acetate.

The aerosol-generating article of the present invention comprises an aerosol-forming substrate. As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

The aerosol-generating article of the present invention may be configured for use with an aerosol-generating device. As used herein, an 'aerosol-generating device' relates to a device that interacts with an aerosol-forming substrate to generate an aerosol. Alternatively, the aerosol-generating article of the present invention may itself comprise a heat source and at least one heat-conducting element for transferring heat from the heat source to the aerosol-forming substrate of the article.

Preferably, the aerosol-forming substrate comprises plant material and an aerosol former.

Preferably, the plant material is a plant material comprising an alkaloid, more preferably a plant material comprising nicotine, and more preferably a tobacco-containing material.

Preferably, the aerosol-forming substrate comprises at least 70 percent of plant material, more preferably at least 90 percent of plant material by weight on a dry weight basis. Preferably, the aerosol-forming substrate comprises less than 95 percent of plant material by weight on a dry weight basis, such as from 90 to 95 percent of plant material by weight on a dry weight basis.

Preferably, the aerosol-forming substrate comprises at least 5 percent of aerosol former, more preferably at least 10 percent of aerosol former by weight on a dry weight basis. Preferably, the aerosol-forming substrate comprises less than 30 percent of aerosol former by weight on a dry weight basis, such as from 5 to 30 percent of aerosol former by weight on a dry weight basis.

In some particularly preferred embodiments, the aerosol-forming substrate comprises plant material and an aerosol former, wherein the substrate has an aerosol former content of between 5% and 30% by weight on a dry weight basis. The plant material is preferably a plant material comprising an alkaloid, more preferably a plant material comprising nicotine, and more preferably a tobacco-containing material.

Alkaloids are a class of naturally occurring nitrogen-containing organic compounds. Alkaloids are found mostly in plants, but are also found in bacteria, fungi and animals.

Examples of alkaloids include, but are not limited to, caffeine, nicotine, theobromine, atropine and tubocurarine. A preferred alkaloid is nicotine, which may be found in tobacco.

An aerosol-forming substrate may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco. The aerosol-forming substrate may comprise both solid and liquid components. The aerosol-forming substrate may comprise a tobacco-containing material containing volatile tobacco flavour compounds, which are released from the substrate upon heating. The aerosol-forming substrate may comprise a non-tobacco material. The aerosol-forming substrate may further comprise an aerosol former. Examples of suitable aerosol formers are glycerine and propylene glycol.

In some preferred embodiments, the aerosol-forming substrate may comprise a textured sheet of homogenised tobacco material with an aerosol former content of between 5% and 30% by weight on a dry weight basis.

Use of a textured sheet of homogenised tobacco material may advantageously facilitate gathering of the sheet of homogenised tobacco material to form the aerosol-forming substrate.

As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate.

The aerosol-forming substrate of the present invention preferably comprises an aerosol former. As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine. The aerosol-forming substrate may comprise a single aerosol former. Alternatively, the aerosol-forming substrate may comprise a combination of two or more aerosol formers.

Preferably, the aerosol-forming substrate is in the form of a rod comprising a gathered sheet of aerosol-forming material, for example a gathered sheet of homogenised tobacco, or a gathered sheet comprising a nicotine salt and an aerosol former.

Aerosol-forming substrates comprising gathered sheets of homogenised tobacco for use in the aerosol-generating article may be made by methods known in the art, for example the methods disclosed in WO 2012/164009 A2.

Preferably, the aerosol-forming substrate has an external diameter of at least 5 mm. The aerosol-forming substrate may have an external diameter of between approximately 5 mm and approximately 12 mm, for example of between approximately 5 mm and approximately 10 mm or of between approximately 6 mm and approximately 8 mm. In a preferred embodiment, the aerosol-forming substrate has an external diameter of 7.2 mm+/−10%.

The aerosol-forming substrate may have a length of between approximately 5 mm and approximately 15 mm, for example between about 8 mm and about 12 mm. In one embodiment, the aerosol-forming substrate may have a length of approximately 10 mm. In a preferred embodiment, the aerosol-forming substrate has a length of approximately 12 mm. Preferably, the aerosol-forming substrate is substantially cylindrical.

A support element may be located immediately downstream of the aerosol-forming substrate and may abut the aerosol-forming substrate.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube.

The support element preferably has an external diameter that is approximately equal to the external diameter of the aerosol-generating article.

The support element may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the support element has an external diameter of 7.2 millimetres+/−10%.

The support element may have a length of between approximately 5 millimetres and approximately 15 millimetres. In a preferred embodiment, the support element has a length of approximately 8 millimetres.

An aerosol-cooling element may be located downstream of the aerosol-forming substrate, for example an aerosol-cooling element may be located immediately downstream of a support element, and may abut the support element.

As used herein, 'aerosol-cooling element' refers to a component of an aerosol-generating article located downstream of the aerosol-forming substrate such that, in use, an aerosol formed by volatile compounds released from the aerosol-forming substrate passes through and is cooled by the aerosol cooling element before being inhaled by a user. Preferably, the aerosol-cooling element is positioned between the aerosol-forming substrate and the mouthpiece. An aerosol cooling element has a large surface area, but causes a low pressure drop. Filters and other mouthpieces that produce a high pressure drop, for example filters formed from bundles of fibres, are not considered to be aerosol-cooling elements. Chambers and cavities within an aerosol-generating article are not considered to be aerosol cooling elements.

As used herein, the term 'rod' is used to denote a generally cylindrical element of substantially circular, oval or elliptical cross-section.

The plurality of longitudinally extending channels may be defined by a sheet material that has been crimped, pleated, gathered or folded to form the channels. The plurality of longitudinally extending channels may be defined by a single sheet that has been pleated, gathered or folded to form multiple channels. The sheet may also have been crimped. Alternatively, the plurality of longitudinally extending channels may be defined by multiple sheets that have been crimped, pleated, gathered or folded to form multiple channels.

As used herein, the term 'sheet' denotes a laminar element having a width and length substantially greater than the thickness thereof.

As used herein, the term 'longitudinal direction' refers to a direction extending along, or parallel to, the cylindrical axis of a rod.

As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod.

As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

Preferably, the aerosol-cooling element has a reduced length relative to aerosol-cooling elements known in the art. That is, preferably the aerosol cooling element has a length of about 15 millimetres or less, more preferably a length of 10 millimetres or less, more preferably a length of 7 or 5 millimetres or less. The length of the aerosol cooling element may be at least 1 millimetre. Preferably, the ratio of the length of the aerosol-generating article to the length of the aerosol-cooling element is at least 3 to 1, or 4 to 1, more preferably at least 5 to 1, even more preferably at least 6 to 1.

Alternatively, the aerosol-generating article may not have an aerosol-cooling element. In this case, the filter segment may be located immediately downstream of the aerosol-forming substrate, or immediately downstream of the support element (if present). A cavity may be provided in the aerosol-generating article between the filter segment and the aerosol-forming substrate, or between the filter segment and the support element (if present). The cavity preferably extends from the aerosol-generating substrate to the filter segment, or from the support element (if present) to the filter segment. Preferably, the cavity has a length of about 15 millimetres or less, more preferably a length of about 10 millimetres or less, more preferably a length of about 7 or about 5 millimetres or less. The length of the aerosol cooling element may be at least 1 millimetre. Preferably, the ratio of the length of the aerosol-generating article to the length of the cavity is at least 3 to 1, or 4 to 1, more preferably at least 5 to 1, even more preferably at least 6 to 1.

If an aerosol-cooling element is present, preferably the ratio of the length of the filter segment to the length of the aerosol-cooling element is at least at 1 to 1, or 2 to 1, more preferably at least 3 to 1, even more preferably at least 4 to 1. More preferably, the ratio of the length of the filter segment to the length of the aerosol-cooling element is at least 5 to 1, at least 15 to 2, or at least 10 to 1. Preferably, the length of the aerosol-cooling element is no greater than 50 percent of the length of the filter segment, more preferably no greater than 25 percent of the length of the filter segment, even more preferably no greater than 20 percent of the length of the filter segment. Preferably, the length of the aerosol-cooling element is no greater than 15 percent of the length of the filter segment, more preferably no greater than 10 percent of the length of the filter segment, even more preferably no greater than 5 percent of the length of the filter segment.

If an aerosol-cooling element is present, the aerosol-cooling element may be located between the support element and the filter segment located at the extreme downstream end of the aerosol-generating article.

If the aerosol-cooling element is not present and a cavity is provided in the aerosol-generating article between the filter segment and the aerosol-forming substrate, preferably the ratio of the length of the filter segment to the length of the cavity is at least at 1 to 1, or at least 2 to 1, more preferably at least 3 to 1, even more preferably at least 4 to 1. More preferably, the ratio of the length of the filter segment to the length of the cavity is at least 5 to 1, even more preferably at least 15 to 2, even more preferably at least 10 to 1. Preferably, the length of the cavity is no greater than 50 percent of the length of the filter segment, more preferably no greater than 25 percent of the length of the filter segment, even more preferably no greater than 20 percent of the length of the filter segment. Preferably, the length of the cavity is no greater than 15 percent of the length of the filter segment, more preferably no greater than 10 percent of the length of the filter segment, even more preferably no greater than 5 percent of the length of the filter segment.

The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length. In some embodiments, the aerosol-cooling element may have a substantially circular cross-section and a diameter of about 5 mm to about 10 mm. For example, an aerosol-cooling element may have a diameter of about 7 mm.

The aerosol-cooling element may be alternatively termed a heat exchanger.

The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. The plurality of longitudinally extending channels may be defined by multiple sheets that have been one or more of crimped, pleated, gathered and folded to form multiple channels.

The aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

Preferably, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-cooling element may be formed from a gathered sheet of material having a specific surface area of between approximately 10 square millimetres per milligram and approximately 100 square millimetres per milligram weight. In some embodiments, the aerosol-cooling element may be formed from a gathered sheet of material having a specific surface area of approximately 35 $mm^2/mg$.

The aerosol-generating article of the present invention may be used in conjunction with an aerosol-generating device to create an aerosol. That is a user may use a device that interacts with an aerosol-forming substrate to generate an aerosol. The device may comprise one or more components used to supply energy from a power supply to an aerosol-forming substrate to generate an aerosol. The aerosol-generating device may be described as a heated aerosol-generating device, which is an aerosol-generating device comprising a heater. The heater is preferably used to heat an aerosol-forming substrate of an aerosol-generating article to generate an aerosol. The aerosol-generating device may be an electrically heated aerosol-generating device, which is an aerosol-generating device comprising a heater that is operated by electrical power to heat an aerosol-forming substrate of an aerosol-generating article to generate an aerosol. An aerosol-generating device may be a gas-heated aerosol-generating device. An aerosol-generating device may be a smoking device that interacts with an aerosol-forming substrate of an aerosol-generating article to generate an aerosol that is directly inhalable into a user's lungs thorough the user's mouth.

The aerosol-generating article of the present invention may itself comprise a heat source and at least one heat-conducting element for transferring heat from the heat source to the aerosol-forming substrate of the article. Preferably, the heat source is combustible. Preferably, the heat source is upstream of the aerosol-forming substrate. In particularly preferred embodiments, the aerosol-generating article comprises a combustible carbonaceous heat source upstream of the aerosol-forming substrate. As used herein, the term 'carbonaceous' is used to describe a combustible heat source comprising carbon. Advantageously, the heat-conducting element is around and in contact with at least a rear portion of the combustible heat source and at least a front portion of the wrapper. Advantageously, the heat-conducting element is around and in direct contact with at least a rear portion of the combustible heat source and at least a front portion of the wrapper. In such embodiments, the heat-conducting element provides a thermal link between the combustible heat source and the aerosol-forming substrate of the aerosol-generating article. This advantageously helps to facilitate adequate heat transfer from the combustible heat source to the aerosol-forming substrate to provide an acceptable aerosol. The combustible heat source is located at or proximate to the distal end of the aerosol-generating article. Preferably, the combustible heat source is substantially cylindrical.

The combustible heat source may have a length of between about 7 mm and about 17 mm, for example a length of between about 7 mm and about 15 mm or a length of between about 7 mm and about 13 mm.

The combustible heat source may have a diameter of between about 5 mm and about 9 mm, for example a diameter of between about 7 mm and about 8 mm.

The aerosol-generating article may comprise a cap configured to at least partially cover a front portion of the combustible heat source. In such embodiments, the cap is removable to expose a front portion of the combustible heat source prior to use of the aerosol-generating article.

As used herein, the term 'cap' is used to describe a protective cover at the distal end of the aerosol-generating article that substantially surrounds a front portion of the combustible heat source.

The aerosol-generating article may comprise a non-combustible substantially air impermeable barrier between a rear end face of the combustible heat source and the aerosol-forming substrate.

Inclusion of a non-combustible substantially air impermeable barrier between the rear end face of the combustible heat source and the aerosol-forming substrate may advantageously limit the temperature to which the aerosol-forming substrate is exposed during ignition and combustion of the combustible heat source. This may help to avoid or reduce thermal degradation or combustion of the aerosol-forming substrate during use of the aerosol-generating article.

Inclusion of a non-combustible substantially air impermeable barrier between the rear end face of the combustible heat source and the aerosol-forming substrate may advantageously substantially prevent or inhibit migration of components of the aerosol-forming substrate to the combustible heat source during storage and use of the aerosol-generating article.

As used herein, the term 'non-combustible' is used to describe a barrier that is substantially non-combustible at temperatures reached by the combustible heat source during ignition and combustion thereof.

The front end face of the combustible heat source is at the upstream end of the combustible heat source. The upstream end of the combustible heat source is the end of the combustible heat source furthest from the proximal end of the aerosol-generating article. A rear end face of the combustible heat source is opposed to the front end face of the combustible heat source. The rear end face of the combustible heat source is at the downstream end of the combustible heat source. The downstream end of the combustible heat source is the end of the combustible heat source closest to the proximal end of the aerosol-generating article.

The barrier may abut one or both of the rear end face of the combustible heat source and the aerosol-forming substrate. Alternatively, the barrier may be spaced apart from one or both of the rear end face of the combustible heat source and the aerosol-forming substrate.

Advantageously, the barrier is adhered or otherwise affixed to the rear end face of the combustible heat source.

It will be appreciated that each of the above described features may be equally applicable to one or more of the aspects of the present invention. It will be further appreciated that the preferred features may be combinable with one another in any suitable combination.

Specific embodiments will now be described with reference to the figures, in which.

Figure 1:
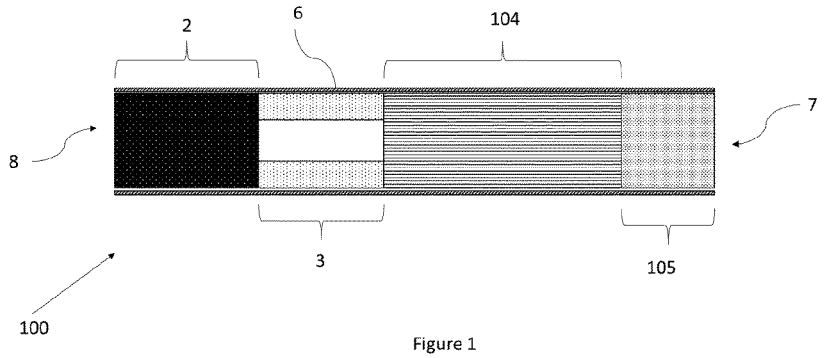
FIG. 1 is a schematic cross-sectional diagram of a prior art aerosol-generating article.

FIG. 1 illustrates a prior art aerosol-generating article 100. The article 1 comprises four elements. The elements are: an aerosol generating substrate 2, a support element 3, an aerosol-cooling element 104 and a filter segment 105 comprising cellulose acetate fibres having a denier per filament of about 8.

The four elements are arranged sequentially and in coaxial alignment and are assembled by a cigarette paper 6 to form a rod. The rod has a mouth-end 7, which a user inserts into his or her mouth during use, and a distal end 8 located at the opposite end of the rod to the mouth end 7. Elements located between the mouth-end 7 and the distal end 8 can be described as being upstream of the mouth-end 7 or, alternatively, downstream of the distal end 8. When assembled, the rod is 52 millimetres long and has a diameter of 7.2 millimetres. The filter segment 105 has a length of 8 millimetres and the aerosol-cooling element 104 has a length of 17 millimetres.

Figure 2:
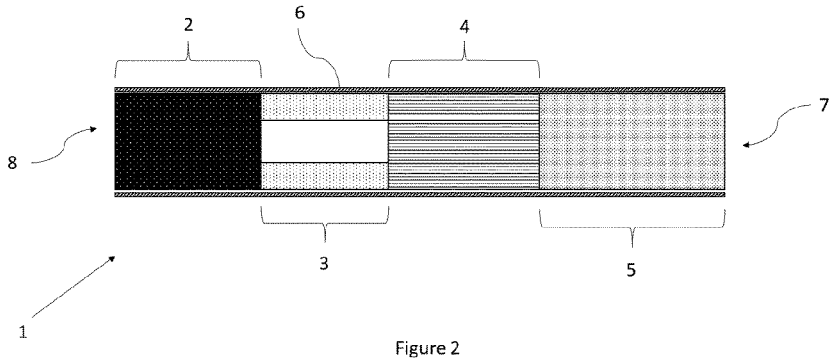
FIG. 2 is a schematic cross-sectional diagram of an aerosol-generating article in accordance with a first embodiment of the present invention.

FIG. 2 illustrates an aerosol-generating article 1 according to a first embodiment of the present invention. The article differs from the prior art article 100 of FIG. 1, in that the filter segment 5 comprises cellulose acetate fibres having a denier per filament of 30. The filter segment 5 of FIG. 2 is also longer that segment 105 of FIG. 1, and has a length of 20 millimetres. Consequently, the aerosol-cooling element of FIG. 2 has a shorter length, of 5 millimetres.

Figure 3:
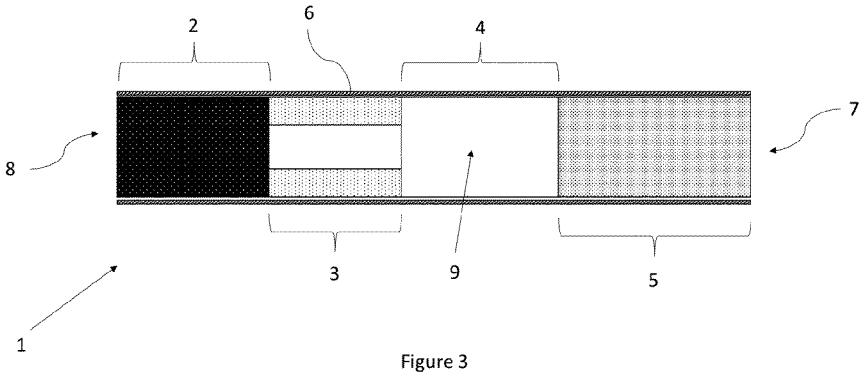
FIG. 3 is a schematic cross-sectional diagram of an aerosol-generating article in accordance with a second embodiment of the present invention.

FIG. 3 illustrates an aerosol-generating article 1 according to a second embodiment of the present invention. The article is substantially the same as the article of FIG. 2. However, the article of FIG. 3 does not comprise an aerosol-cooling element. Instead, a cavity 9 is provided between the filter segment 5 and the support element 3, and extends from the support element 3 to the filter segment 5.

Figure 4:
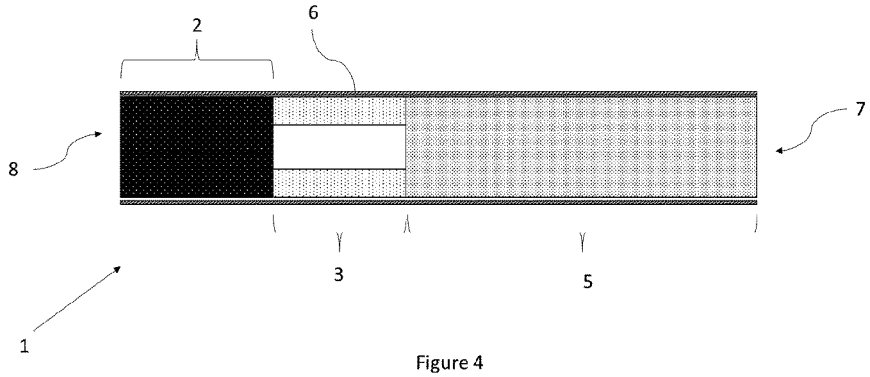
FIG. 4 is a schematic cross-sectional diagram of an aerosol-generating article in accordance with a third embodiment of the present invention.

FIG. 4 illustrates an aerosol-generating article 1 according to a third embodiment of the present invention. The article is substantially the same as the article of FIGS. 2 and 3. However, the article of FIG. 4 does not have a cavity or an aerosol-cooling element between the support element 3 and the filter segment 5. Instead, the filter segment 5 has an increased length of 25 millimetres and extends all the way to the support element 3. That is, the filter segment 5 is located immediately downstream of the support element 3.

Each of FIGS. 2 to 4 result in an aerosol-generating article 1 that may be able to provide the same filtration efficiency and resistance to draw as the article of FIG. 1, and have the same length as the article of FIG. 1, with a reduced or eliminated the need for an aerosol-cooling element.

The invention claimed is:

1. An aerosol-generating article for generating an inhalable aerosol when heated, comprising:

a plurality of components assembled within a wrapper to form a rod having a mouth end and a distal end upstream from the mouth end, the plurality of components comprising:

an aerosol-forming substrate comprising plant material and an aerosol former, wherein the aerosol-forming substrate has an aerosol former content of between 5% and 30% by weight on a dry weight basis;

a filter segment downstream of the aerosol-forming substrate, the filter segment comprising fibres of at least 12 denier per filament, and wherein the filter segment has a total denier of from about 24,000 to about 60,000; and a support element located immediately downstream of the aerosol-forming substrate, wherein the support element abuts the aerosol-forming substrate, and wherein the support element comprises a hollow tubular element.

2. The aerosol-generating article according to claim 1, wherein a cavity is provided between the filter segment and the aerosol-forming substrate.

3. The aerosol-generating article according to claim 2, wherein a ratio of a length of the aerosol-generating article to a length of the cavity is at least 3 to 1.

4. The aerosol-generating article according to claim 2, wherein the cavity is defined by the wrapper.

5. The aerosol-generating article according to claim 1, wherein the fibres of the filter segment have an elliptical or a circular cross section.

6. The aerosol-generating article according to claim 1, wherein a length of the filter segment is at least about 10 percent of a length of the aerosol-generating article.

7. The aerosol-generating article according to claim 1, wherein the filter segment comprises at least 50% by weight of fibres of at least 12 denier per filament.

8. The aerosol-generating article according to claim 1, wherein the filter segment has a resistance to draw of from about 0.4 mm $H_2O$ to about 3 mm $H_2O$ per millimetre length.

9. The aerosol-generating article according to claim 1, wherein the filter segment has a resistance to draw of from about 0.6 mm $H_2O$ to about 1.5 mm $H_2O$ per millimetre length.

10. The aerosol-generating article according to claim 1, wherein the filter segment has a resistance to draw of from about 0.8 mm $H_2O$ to about 1.2 mm $H_2O$ per millimetre length.

* * * * *